United States Patent [19]

Lepper et al.

[11] Patent Number: 4,652,406

[45] Date of Patent: Mar. 24, 1987

[54] PROCESS FOR THE PRODUCTION OF FATTY ACID ALKYL ESTERS

[75] Inventors: Herbert Lepper; Lothar Friesenhagen, both of Duesseldorf, Fed. Rep. of Germany

[73] Assignee: Henkel Kommanditgesellschaft auf Aktien, Duesseldorf, Fed. Rep. of Germany

[21] Appl. No.: 806,074

[22] Filed: Dec. 6, 1985

[30] Foreign Application Priority Data

Dec. 8, 1984 [DE] Fed. Rep. of Germany ..... 3444893

[51] Int. Cl.[4] ..... C11C 3/04; C11C 1/08

[52] U.S. Cl. ..... 260/410.9 R; 260/421; 260/428.5

[58] Field of Search ..... 260/410.9 E, 421, 428.5

[56] References Cited

U.S. PATENT DOCUMENTS

| | | | |
|---|---|---|---|
| Re. 22,751 | 4/1946 | Trent | 260/410.9 E |
| 2,360,844 | 11/1941 | Bradshaw et al. | 260/410.9 |
| 2,383,599 | 8/1945 | Glossor | 260/410.9 E |
| 2,383,601 | 8/1945 | Keim | 260/410.9 E |
| 2,486,444 | 11/1949 | Smith | 260/410.9 E |
| 4,164,506 | 8/1979 | Kawahara et al. | 260/421 |

OTHER PUBLICATIONS

Ullmanns Encyklopaedie der technischen Chemie, 4th Edition, vol. 11, (1976), (p. 432).

*Primary Examiner*—J. E. Evans

*Attorney, Agent, or Firm*—Ernest G. Szoke; Henry E. Millson, Jr.

[57] ABSTRACT

Fatty acid alkyl esters are produced by catalytic transesterification of natural fats and oils containing free fatty acids. In a preliminary esterifying step, the free fatty acids present are reacted with a $C_1$–$C_4$ alkanol (e.g., methanol) in the presence of an acidic esterification catalyst, at a temperature of about 50° to 120° C. and at substantially atmospheric pressure. The resulting reaction mixture is allowed to separate into two phases: (1) an alcohol phase containing the acidic esterification catalyst and part of the water of reaction and (2) an oil phase. These phases separately recovered. The oil phase is then extracted with an immiscible extractant, preferably comprising a mixture of glycerol and methanol, to remove residual water of reaction. In the final step the extracted oil phase is transesterified with a $C_1$–$C_4$ alkanol, e.g. methanol, in the presence of an aklali catalyst and at substantially atmospheric pressure.

9 Claims, No Drawings

PROCESS FOR THE PRODUCTION OF FATTY ACID ALKYL ESTERS

BACKGROUND OF THE INVENTION

1. Field of The Invention

This invention relates to a process for the production of fatty acid alkyl esters, particularly methyl esters, from natural fats and oils containing free fatty acids by catalytic transesterification.

2. Description of Related Art

Fatty acid methyl esters have acquired considerable commercial significance as starting materials for the production of fatty alcohols and other oleochemical products, such as ester sulfonates, fatty acid alkanolamides and soaps. On an industrial scale, fatty acid methyl esters are mainly produced by catalytic transesterification (alcoholysis) of fatty acid triglyceride mixtures of the type present in fats and oils of vegetable and animal origin.

Natural fats and oils almost always contain considerable quantities of free fatty acids. Their content of free fatty acids varies over a wide range, depending on the origin of the material and its previous history, and almost always exceeds about 3% by weight.

Various processes are available for the transesterification of naturally occurring fatty acid triglycerides with alcohols. The choice of process conditions depends to a large extent upon the quantity of free fatty acids present in the triglyceride mixture.

Atmospheric transesterification of fats and oils to form the corresponding fatty acid ester mixtures may be effected with a 0.5 to 1.0-molar excess of alcohol in the presence of an alkali catalyst under atmospheric pressure and at temperatures of 25° to 100° C. Such a process is described in U.S. Pat. No. 2,360,844 as the first stage of a soap manufacturing process. This alkali-catalyzed, atmospheric transesterification process may be carried out without any problems as long as the starting materials used are fats and oils which are substantially free from water and which have a free fatty acid content of less than 0.5% by weight (corresponding to an acid number of about 1).

Fats and oils having a relatively high content of free fatty acids may be transesterified in a high pressure transesterification process with a 7- to 8-molar excess of methanol in the presence of alkali or zinc catalysts to form the corresponding fatty acid methyl esters. This process is carried out at a temperature of 240° C. and at a pressure of about 100 bar. (Ullmann, Enzyklopadie der technischen Chemie, 4th Edition, Vol. 11 (1976), page 432).

Compared with high-pressure transesterification, atmospheric transesterification uses considerably less methanol and, by virtue of the lower reaction temperatures, less energy. In addition, atmospheric transesterification does not require expensive pressure reactors. Commercial grade fats and oils, however, almost always contain relatively large quantities of water and fatty acids. As a result, atmospheric transesterification of these commercial mixtures requires preliminary drying and a reduction in the acid number, for example by conversion of the free fatty acids into the corresponding alkyl or glycerol esters in a pre-esterification reaction. Pre-esterification of the acid-containing fats and oils may be carried out in the presence of alkaline catalysts at temperatures of 240° C. and at pressures of 20 bar. (Ullmann, Enzyklopadie der technischen Chemie, 4th Edition, Vol. 11 (1976), page 432). This method of pre-esterification with methanol also requires the use of expensive pressure reactors.

An object of the present invention is to facilitate the production of fatty acid esters, particularly methyl esters, from triglyceride starting materials containing relatively large quantities of water and free fatty acids.

DESCRIPTION OF THE INVENTION

According to the invention, this and other objects are achieved by a process for the production of fatty acid alkyl esters by catalytic transesterification of natural fats and oils containing free fatty acids with an alkanol which process comprises:

(a) esterifying the free fatty acids present in the natural fats and oils with a molar excess of a first alkanol having 1 to 4 carbon atoms in the presence of an acidic esterification catalyst, at a temperature of about 50° to 120° C. and at substantially atmospheric pressure;

(b) separately recovering from the reaction mixture of step (a), (i) an alcohol phase containing the acidic esterification catalyst and part of the water of reaction, and (ii) an oil phase;

(c) extracting the separately recovered oil phase with an immiscible extractant to remove residual water of reaction, and (d) transesterifying the extracted oil phase with a second alkanol having 1 to 4 carbon atoms in the presence of an alkali catalyst and at substantially atmospheric pressure.

The process of this invention finds particular commercial interest when the alkanol used in both pre-esterification and transesterification is methanol and the immiscible extractant is the mixture of glycerol and methanol recovered from the transesterification step.

By sequentially combining pre-esterification of the free fatty acids and subsequent transesterification into an overall process, all process steps can be carried out at comparatively low temperatures and without any need for pressure reactors. In addition, excess alcohol required for transesterification can be kept at a minimum. The process of the present invention enables fatty acid esters to be produced in an inexpensive, energy-efficient manner, even from starting materials such as fats and oils of vegetable or animal origin.

Suitable starting materials for the process of the present invention include virtually any fats and oils of vegetable or animal origin. Of course, fats and oils having a free fatty acid content that is naturally low enough that they may be directly subjected, without any disadvantages, to alkali-catalyzed, atmospheric transesterification need not be treated using the present invention. Possible starting materials for the present invention include, in particular, coconut oil, palm kernel oil, olive oil, rapeseed oil, cottonseed oil, lard oil, fish oil and beef tallow. The acid number of the natural fats and oils, and hence their free fatty acid content, may vary within wide limits. For example, the acid number of commercial, crude coconut oil is generally not above 20. Other vegetable oils have acid numbers ranging from below about 10 (good qualities) to 20–25 (inferior qualities). Commercial tallows, which are valued and handled according to their acid number, have acid numbers ranging from about 1 to 40, sometimes even higher, corresponding to a free fatty acid content of from about 0.5 to 20% by weight. In extreme cases, the acid number of a suitable starting material for the process according to the present invention may reach a level of 60 or higher.

In the first step of the process of the present invention, free fatty acids present in the starting triglyceride mixture are esterified with a molar excess (relative to the fatty acids) of an alkanol having 1 to 4 carbon atoms in the presence of an acidic esterification catalyst. The preferred alkanol for this pre-esterification step is methanol and for convenience the invention will be described with reference to this preferred reagent. Comparatively mild reaction conditions are selected for this step, so that transesterification of the triglycerides takes place only to a limited extent, if at all.

The ratio between triglyceride starting material and methanol is best selected so that, on the one hand, a distinct molar excess of methanol is provided relative to the free fatty acid content to be esterified, while, on the other hand, a clean separation into an oil phase and a methanol phase at the end of the reaction is guaranteed. Generally, to achieve this result, from about 20 to 50 percent by volume of methanol is normally used, based on the volume of triglyceride starting material. Preferred amounts for this pre-esterification reaction are about 25 to 40 percent by volume with the most preferred being about 30 percent by volume. These ratios roughly correspond to molar ratios of methanol to free fatty acid of about 10:1 to 50:1 depending on the nature and acid number of the triglyceride starting material. Preferably a molar ratio of about 25:1 is employed.

Larger quantities of methanol have a positive effect upon the velocity and completeness of the esterification of the free fatty acids. Even though the solubility of methanol in natural triglycerides, which is constant for a given reaction temperature, is limited, it has been found that an increase in the quantity of methanol used produces more rapid and more complete esterification of the free fatty acids. With the economy of the process in mind, however, it is generally advisable to impose an upper limit, as above indicated, on the quantity of methanol used in the pre-esterification reaction, because recovery of the excess alcohol is a significant cost factor.

Suitable catalysts for pre-esterification include any acidic, non-volatile esterification catalysts, for example the corresponding systems based on Lewis acids, substantially non-volatile inorganic acids and their partial esters and heteropolyacids. Particularly suitable esterification catalysts include alkyl, aryl or alkaryl sulfonic acids, such as for example methane sulfonic acid, naphthalene sulfonic acid, p-toluene sulfonic acid and dodecyl benzene sulfonic acid. Sulfuric acid and glycerol monosulfuric acid are suitable as examples of substantially non-volatile inorganic acids and partial esters thereof. Suitable heteropolyacids include tungstato- and molybdato-phosphoric acids. These catalysts generally are used in quantities of from about 0.1 to 5 percent by weight of the fat or oil starting material, and preferably in quantities of from about 0.5 to 1.0 percent by weight.

The pre-esterification step is generally carried out at substantially atmospheric pressure. The term "substantially atmospheric pressure" as used herein is intended to include slight positive pressures, e.g. up to about 5 bar, at which special pressure reactors are not required. The reaction temperature can vary between about 50° and 120° C., and to a certain extent is a function of pressure. Preferably the reaction temperature will range from about 60° to 110° C. Generally, the reaction is conducted at reflux conditions for the selected alkanol reagent and reaction pressure. Preferably, the reaction is conducted at atmospheric reflux conditions, i.e. for methanol at about 65° C.

In this pre-esterification step, the reactants and the catalyst are heated with vigorous stirring to the reaction temperature and are kept at that temperature until the acid number of the oil phase has fallen to the required level. In order to achieve optimal results in subsequent transesterification of the natural fat or oil, the acid number of the oil phase preferably is reduced to a value below about 1 by pre-esterification.

Pre-esterification according to the present invention may be carried out either batchwise or continuously. Where it is carried out continuously, the alkanol and oil components may be circulated in countercurrent or cocurrent fashion.

On completion of the reaction, the reaction mixture is left standing, without stirring to permit its separation into an oil phase and an alkanol (e.g. methanol) phase. In the preferred embodiment the reaction mixture is cooled to a temperature in the range of from about 40° to 60° C., and most preferably to about 50° C. to facilitate phase separation. The two liquid phases are then separately recovered in a known manner, e.g., by decantation. The methanol phase, which contains most of the water of reaction and almost all of the catalyst, is processed, for example, using distillation or other suitable techniques to recover the catalyst and the methanol for recycling. Distillation is preferred since the distillation residue (containing the catalyst) can be reused as a catalyst in the pre-esterification step of the process of the present invention without further purification.

The next step of the process of the present invention is the extraction of the separately recovered oil phase to further reduce its content of reaction water and pre-esterification catalyst. Extraction of the oil phase is carried out with an immiscible extractant. In general, any organic extractant which is immiscible with the oil phase and has a higher affinity than the oil phase for the aqueous components may be used to effect the extraction of reaction water and residual catalyst. The preferred class of extractants is alcohols. Most preferred are mixtures of glycerol and the alkanol used in the pre-esterification and transesterification steps (e.g., methanol, ethanol, etc.). Mixtures of glycerol and methanol, useful according to the most preferred embodiment, typically have a ratio by weight of glycerol to methanol of from about 1:0.25 to about 1:1.25. Preferably a mixture having a ratio of about 1:0.4 to 1:0.6 is used. In this connection, it has proved to be particularly convenient to use the mixture of glycerol and methanol which is recovered in the alkali-catalyzed, atmospheric transesterification step of the present invention (called the "glycerol phase"). This "glycerol phase" typically comprises:

- about 40 to 70% by weight of glycerol,
- about 20 to 50% by weight of methanol,
- about 5 to 15% by weight of fatty acid derivatives (soaps, methyl esters), and
- about 0.1 to 0.2% by weight of free alkali. The "glycerol phase" may be used in the extraction step without preliminary purification steps.

In practicing the extraction step of the process of the present invention, the immiscible extractant (glycerol and methanol mixture) should be used in an amount, and contacted for a time, sufficient to reduce the water content in the oil phase to below about 0.15% and preferably below about 0.10%. In general, depending on the particular extractant composition, the foregoing objectives will be met with extractant concentrations of from about 10 to 30 percent by weight based on the oil phase. Preferably, an amount of the glycerolmethanol mixture extractant from about 15 to 25 percent by weight based on the oil phase is employed.

To carry out the extraction, the extractant (e.g., glycerol and methanol mixture) is added to the oil phase recovered from the pre-esterification step and the mixture obtained is vigorously stirred for about 1 to 15 and preferably about 5–10 minutes. The mixture then is left standing without stirring until phase separation occurs and the extracted oil phase is separately recovered. While ambient temperatures can be employed during the extraction step, to obtain the optimum degree of separation of the water of reaction still present and any catalyst residue from the oil phase, the entire extraction process is preferably conducted at a temperature within the range of about 40° to 60° C. and most preferably at about 50° to 55° C.

The extraction may be carried out batchwise in a simple stirrer-equipped vessel. Where the present process is carried out continuously, this step may be carried out in a cascade of stirrer-equipped vessels or in a column equipped with static mixing elements. The oil phase and the extractant (glycerol and methanol mixture) may also be continuously passed in countercurrent flow through an extraction column. Other techniques and equipment for extracting the oil phase in accordance with this step will be apparent to those skilled in this technology.

In the final step of the process of this invention, the de-acidified and largely anhydrous triglycerides are subjected to atmospheric alkali-catalyzed transesterification in a known manner with an alkanol having 1 to 4 carbon atoms. Preferred is the same alkanol used in the pre-esterification step of the present invention. The most preferred alkanol for both steps is methanol and for convenience the transesterification step will be described with reference thereto. The transesterification reaction should be carried out with substantially anhydrous methanol. In general, the methanol is used in a 50% to 150% excess over the stoichiometric quantity required for the transesterification reactions. Suitable catalysts include alkali metal hydroxides, particularly sodium and potassium hydroxide, and alkali metal alcoholates, particularly sodium methylate. In measuring the quantity of catalyst, it is essential to take into account any residue of free fatty acids still present in the triglyceride in question. Over and above the quantity required to neutralize any free fatty acids, the catalysts are used in quantities of from about 0.05 to 0.2 percent by weight based on the triglycerides. Preferred are catalyst quantities of from about 0.1 to 0.2 percent by weight, with about 0.15 percent by weight being most preferred.

The mixture of triglycerides (oil phase), methanol and catalyst is heated with stirring to a reaction temperature in the range of from about 25° to 100° C. While the transesterification reaction takes place sufficiently quickly at a temperature as low as 25° to 30° C., in general, it is preferred to carry out the reaction at temperatures of from about 50° to 100° C. The most preferred reaction temperature is reflux temperature of the alkanol employed, e.g., for methanol, 65° C. The reaction is conducted at substantially atmospheric pressure. In general, the reaction should be continued until substantially all of the bound glycerol in the oil phase is released. In the practice of this invention at least about 95% and preferably at least about 97% of the bound glycerol present is removed. This corresponds roughly to a bound glycerol content (by weight) in the crude alkyl ester of less than about 0.75% and preferably less than about 0.50%. The bound glycerol content of an alkyl ester reaction product can be determined using known analytical techniques such as described in DGF-Einheitsmethoden, Wissenschaftliche Verlagsgesellschaft mbH, Stuttgart, 1950–1984, D-IV, 7 (61) in in conjunction with E-III (79).

When the required degree of transesterification has been reached, the reaction mixture is left standing without stirring until phase separation is complete. Preferably, the reaction mixture is cooled to about 40° to 60° C., most preferably about 50° C. to facilitate the phase separation. The phases then are separately recovered in a known manner. As noted above, the methanol-containing glycerol phase separated from the methyl ester (oil) phase can be used advantageously as the extractant in the extraction step of the invention without purification. The methyl ester phase is further processed in a known manner, for example, by purification and distillation to form the desired starting materials for organic synthesis. The transesterification reaction can be carried out batchwise or continuously in any of the many known non-pressurized reaction systems.

EXAMPLE 1

In a 400 liter stirrer-equipped vessel, 200 l (174 kg) of coconut oil (acid number 15.1), 60 l (47.4 kg) of methanol and 1.6 kg of p-toluene sulfonic acid were heated with stirring for 15 minutes to reflux temperature (65° C.). The reaction mixture was cooled to around 50° C. without further stirring and separated cleanly into an oil phase and a methanol phase which were separately recovered.

40.8 kg of a mixture of glycerol and methanol from an alkali-catalyzed, atmospheric transesterification reaction (59.0% by weight glycerol; 28.1% by weight methanol; 12.8% by weight fatty derivative; 0.1% by weight free alkali) were added at 50° to 55° C. to the separated oil phase (204 kg; acid number 0.8; water content 0.34% by weight; methanol content 14.1% by weight). The two-phase mixture was stirred for 10 minutes. After stirring, the two phases separated cleanly within a few minutes. The glycerol phase was separately recovered leaving 196 kg of an extracted oil phase (acid number 0.4; water content 0.08% by weight; methanol content 10.6% by weight).

The extracted oil phase was heated with stirring for 30 minutes to reflux temperature with 35 l (27.7 kg) of methanol and 0.3 kg of sodium methylate as the transesterification catalyst. The reaction mixture was then cooled to 50° C. The methanol-containing glycerol phase was separately recovered. The crude coconut oil fatty acid methyl ester remaining (188 kg) contained 0.4% by weight bound glycerol, 0.02% by weight water and 8.1% by weight methanol; the acid number was 0.04.

The low content of bound glycerol shows very high conversion. If this value is based on the content of bound glycerol in the coconut oil used (13.2% by weight), it follows by calculation that 97% of the bound glycerol was released during transesterification, leaving only 3% in the crude methyl ester.

COMPARATIVE EXAMPLE 1

Following the procedure of Example 1, 200 l (174 kg) of coconut oil (acid number 15.1) were reacted while stirring at 65° C. (reflux) with 60 l (47.4 kg) of methanol in the presence of 1.6 kg of p-toluene sulfonic acid. The oil phase obtained (204 kg; acid number 0.8; water content 0.34% by weight) was directly subjected to atmospheric transesterification. To this end, the oil phase was heated while stirring for 30 minutes to reflux temperature with 36.5 l (28.8 kg) of methanol and 0.3 kg of sodium-methylate. After cooling to 50° C., the lower phase containing methanol and glycerol was separately recovered. The crude coconut oil fatty acid methyl ester (186 kg) contained 2.3% by weight bound glycerol, 0.09% by weight water and 7.9% by weight methanol; the acid number was 0.04.

In the present example, ie., without intermediate extraction of the oil phase as described in Example 1, the atmospheric, alkali-catalyzed transesterificaction reaction is incomplete, as indicated by the relatively high value for bound glycerol. Only about 83% of the glycerol bound in the triglycerides of the starting material was released.

EXAMPLE 2

This Example shows that the catalyst used in the pre-esterification reaction may readily be recovered from the methanol phase after pre-esterification by distilling off the methanol and water of reaction. When reused, the catalyst does not show any significant loss of activity. The methanol phase (21.3 kg) separated off after pre-esterification in Example 1 was freed from methanol and water at 100° C. under a pressure of 20 mbar. Analysis of the residue produced the following values: 7.4% by weight sulfur; 0.3% by weight water; acid number 131.9; saponification number 277.9.

The residue was taken up in 60 l (47.5 kg) of methanol (water content 0.1% by weight) and stirred for 15 minutes at 65° C. (reflux) with 200 l (174 kg) of coconut oil (acid number 15.1). After cooling to 50° C., the two phases formed were separated. Analysis of the oil phase obtained (210 kg) produced the following values: 0.29% by weight of water, 15.0% by weight of methanol; acid number 0.8.

EXAMPLE 3

The methanol phase accumulating in Example 2 was again concentrated by evaporation and the residue used for another pre-esterification reaction. The results obtained were substantially the same as those obtained in Example 2. The following analytical data were determined for the oil phase: 0.33% by weight of water; 15.5% by weight of methanol; acid number 0.9.

EXAMPLE 4

Following the procedure of Example 1, 200 l (174 kg) of coconut oil (acid number 15.1) were reacted with 60 l (47.4 kg) of methanol at 65° C. (reflux) for 15 minutes in the presence of 0.8 kg of methane sulfonic acid.

The separately recovered oil phase (204 kg) was stirred for 10 minutes at 50° to 55° C. with 40.8 kg of the mixture of glycerol and methanol from an alkali-catalyzed, atmospheric transesterification reaction (55.0% by weight glycerol; 33.7% by weight methanol; 11.2% by weight fatty derivatives; 0.1% by weight free alkali). After phase separation, the oil phase had an acid number of 0.5.

The oil phase (195 kg) was transesterified at 65° C. in the presence of 35 l (27.7 kg) of methanol and 0.3 kg of sodium methylate. The crude coconut oil fatty acid methyl ester obtained (185 kg) contained 0.5% by weight of bound glycerol, 0.02% by weight of water and 7.6% by weight of methanol; its acid number was 0.04.

EXAMPLE 5

Following the procedure of Example 1, 200 l (174 kg) of beef tallow (acid number 21) were pre-esterified with 60 l (47.4 kg) of methanol in the presence of 1.6 kg of p-toluene sulfonic acid with stirring at 65° C. for 15 minutes. The oil phase separately recovered from the reaction mixture was extracted with 40.8 kg of a mixture of glycerol and methanol from a previous alkali-catalyzed, atmospheric transesterification reaction. After separation from the glycerolmethanol phase, the pre-esterified tallow had an acid number of 0.6. Transesterification of the oil phase (192 kg) at 65° C. in the presence of 30 l (23.7 kg) of methanol and 0.3 kg of sodium methylate produced 185 kg of tallow fatty acid methyl ester containing 0.4% by weight bound glycerol, 0.02% by weight water and 6.1% by weight methanol; and having an acid number of 0.03.

EXAMPLE 6

Following the procedure of Example 1, 200 l (174 kg) of coconut oil (acid number 15.1) were reacted with 60 l (47.4 kg) of methanol for 15 minutes at 65° C. in the presence of 0.4 kg of 98% by weight sulfuric acid.

The separately recovered oil phase from the reaction mixture (206 kg; acid number 0.7; water content 0.31% by weight; methanol content 11.3% by weight) was stirred for 10 minutes at 50° to 55° C. with 41.2 kg of a mixture of glycerol and methanol from an alkali-catalyzed, atmospheric transesterification reaction (57.1% by weight glycerol; 33.0% by weight methanol; 9.8% by weight fatty derivatives; 0.1% by weight free alkali). After phase separation, 0.13% by weight of water and 11.6% by weight of methanol were found in the oil phase having an acid number of 0.2.

The oil phase (197 kg) was transesterified at 65° C. in the presence of 35 l (27.7 kg) of methanol and 0.3 kg of sodium methylate. The coconut oil fatty acid methyl ester obtained (188 kg) contained 0.5% by weight bound glycerol, 0.2% by weight water and 6.1% by weight methanol; and had an acid number of 0.04.

COMPARATIVE EXAMPLE 2

The procedure was the same as in Example 6, except that the oil phase obtained from the pre-esterification step was directly subjected to the alkali-catalyzed, atmospheric transesterification reaction without intermediate extraction with the mixture of glycerol and methanol. A coconut oil fatty acid methyl ester containing 2% by weight of bound glycerol was obtained.

Comparison with Example 6 shows that the conversion achieved in the transesterification of the pre-esterified oil can be considerably improved by extracting the pre-esterified oil with a mixture of glycerol and methanol before the transesterification step.

We claim:

1. A process for the production of fatty oil alkyl esters from natural fats and oils containing free fatty acids comprising the steps of:

(a) esterifying the free fatty acids present in said natural fats and oils with a molar excess of a first alkanol having 1 to 4 carbon atoms in the presence of an acidic esterification catalyst, at a temperature of about 50° to 120° C. and at a pressure in the range of from atmospheric pressure to 5 bars;

(b) separately recoving from the reaction mixture of step (a), (i) an alcohol phase containing the acidic esterification catalyst and part of the water of reaction and (ii) an oil phase;

(c) extracting the separately recovered oil phase with a mixture of glycerol and methanol in a weight ratio of from 1:0.25 to 1:1.25 to remove residual water of reaction, and (d) transesterifying the extracted oil phase with a second alkanol having 1 to 4 carbon atoms in the presence of an alkali catalyst and at substantially atmospheric pressure.

2. The process of claim 1 wherein said first and second alkanols are methanol.

3. The process of claim 2, wherein from about 20 to 50 percent by volume of methanol is used based on said natural fats and oils in step (a).

4. The process of claim 1 wherein said acidic esterification catalyst is selected from the group consisting of aliphatic and aromatic sulfonic acids.

5. The process of claim 1 wherein the oil phase separately recovered in step (b) has an acid number below 1.

6. The process of claim 1 wherein said mixture of glycerol and methanol is a by-product recovered from the alkali-catalyzed atmospheric transesterification of the extracted oil phase in step (d).

7. The process of claim 1 wherein said mixture of glycerol and methanol is added in an amount of from about 10 to 30 percent by weight based on the separately recovered oil phase of step (b).

8. The process of claim 1 wherein the transesterification step is carried out at a temperature from about 50° to 100° C.

9. A process for reducing the level of free fatty acids and water present in natural fats and oils prior to atmospheric catalytic transesterification using alkali-catalysis comprising:

(a) esterifying the free fatty acids in said natural fats and oils with a molar excess of a first alkanol having 1 to 4 carbon atoms in the presence of an acidic esterification catalyst, at a temperature of about 50° to 120° C. and at a pressure in the range of from atmospheric pressure to 5 bars;

(b) separately recoving from the reaction mixture of step (a), (i) an alcohol phase containing the acidic esterification catalyst and part of the water of reaction and (ii) and oil phase;

(c) extracting the separately recovered oil phase with a mixture of glycerol and methanol in a weight ratio of from 1:0.25 to 1:1.25 to remove residual water of reaction.

* * * * *